US010199189B2

(12) United States Patent
Cernat et al.

(10) Patent No.: US 10,199,189 B2
(45) Date of Patent: Feb. 5, 2019

(54) SWITCHGEAR ARRANGEMENT

(71) Applicant: SIEMENS AKTIENGESELLSCHAFT, Munich (DE)

(72) Inventors: Radu-Marian Cernat, Berlin (DE); Volker Lehmann, Treuenbrietzen (DE); Andrzej Nowakowski, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 572 days.

(21) Appl. No.: 14/378,789

(22) PCT Filed: Feb. 5, 2013

(86) PCT No.: PCT/EP2013/052231
§ 371 (c)(1),
(2) Date: Aug. 14, 2014

(87) PCT Pub. No.: WO2013/120732
PCT Pub. Date: Aug. 22, 2013

(65) Prior Publication Data

US 2015/0014280 A1 Jan. 15, 2015

(30) Foreign Application Priority Data

Feb. 16, 2012 (DE) ..... 10 2012 202 406

(51) Int. Cl.
*H01H 33/72* (2006.01)
*H01H 33/91* (2006.01)
(Continued)

(52) U.S. Cl.
CPC ..... *H01H 33/72* (2013.01); *H01H 33/91* (2013.01); *H01H 3/60* (2013.01); *H01H 33/7023* (2013.01);
(Continued)

(58) Field of Classification Search
CPC ..... H01H 33/04; H01H 33/56; H01H 33/72; H01H 33/74; H01H 33/91
(Continued)

(56) References Cited

U.S. PATENT DOCUMENTS 3,617,667 A * 11/1971 Kirschner et al. ..... 218/81
4,471,187 A 9/1984 Sturzenegger et al.
(Continued)

FOREIGN PATENT DOCUMENTS

CN 102136392 A 7/2011
CN 202034300 U 11/2011
(Continued)

*Primary Examiner* — Renee S Luebke
*Assistant Examiner* — William Bolton
(74) *Attorney, Agent, or Firm* — Laurence Greenberg; Werner Stemer; Ralph Locher

(57) ABSTRACT

A switchgear includes an interrupter unit. The interrupter unit is provided with first and second switching contact pieces that are movable relative to one another. A switching-gas duct that runs through the interrupter unit originates at an arc gap in which an electric arc can burn. The duct connects the arc gap to the surroundings of the interrupter unit. At least some sections of the switching-gas duct are delimited by mutually encompassing elements similar to an annular duct. One of the elements is a first member which is braced at the end similar to a pipe joint and which has a free end that projects in the direction of the arc gap.

7 Claims, 1 Drawing Sheet

(51) Int. Cl.

| | |
|---|---|
| ***H01H 33/70*** | (2006.01) |
| ***H01H 3/60*** | (2006.01) |
| ***H01H 9/52*** | (2006.01) |
| ***H01H 33/88*** | (2006.01) |

(52) U.S. Cl.
CPC . *H01H 2009/526* (2013.01); *H01H 2033/888* (2013.01); *H01H 2213/006* (2013.01)

(58) Field of Classification Search
USPC ..... 218/13, 51–54, 56–57, 61, 97, 157
See application file for complete search history.

(56) References Cited

U.S. PATENT DOCUMENTS

| | | | | |
|---|---|---|---|---|
| 6,207,917 | B1 * | 3/2001 | Lehmann et al. | 218/43 |
| 7,041,928 | B2 | 5/2006 | Nowakowski | |
| 7,202,435 | B2 * | 4/2007 | Claessens et al. | 218/66 |
| 7,956,306 | B2 | 6/2011 | Ye et al. | |
| 8,389,886 | B2 | 3/2013 | Dahlquist et al. | |
| 2011/0180514 | A1 | 7/2011 | Jin | |
| 2011/0297648 | A1 | 12/2011 | Dienemann et al. | |
| 2012/0261383 | A1 | 10/2012 | Bose et al. | |
| 2014/0209568 | A1 | 7/2014 | Cernat et al. | |

FOREIGN PATENT DOCUMENTS

| | | | |
|---|---|---|---|
| CN | 102349127 | A | 2/2012 |
| CN | 103828011 | A | 5/2014 |
| DE | 10221580 | B3 | 1/2004 |
| DE | 102009057703 | A1 | 6/2011 |
| EP | 0075668 | A2 | 4/1983 |
| EP | 1768150 | A1 | 3/2007 |
| EP | 1930929 | A1 | 6/2008 |
| EP | 2120244 | A1 | 11/2009 |
| JP | S61127542 | U | 8/1986 |
| WO | 2011067122 | A1 | 6/2011 |
| WO | 2013045235 | A1 | 4/2013 |

* cited by examiner

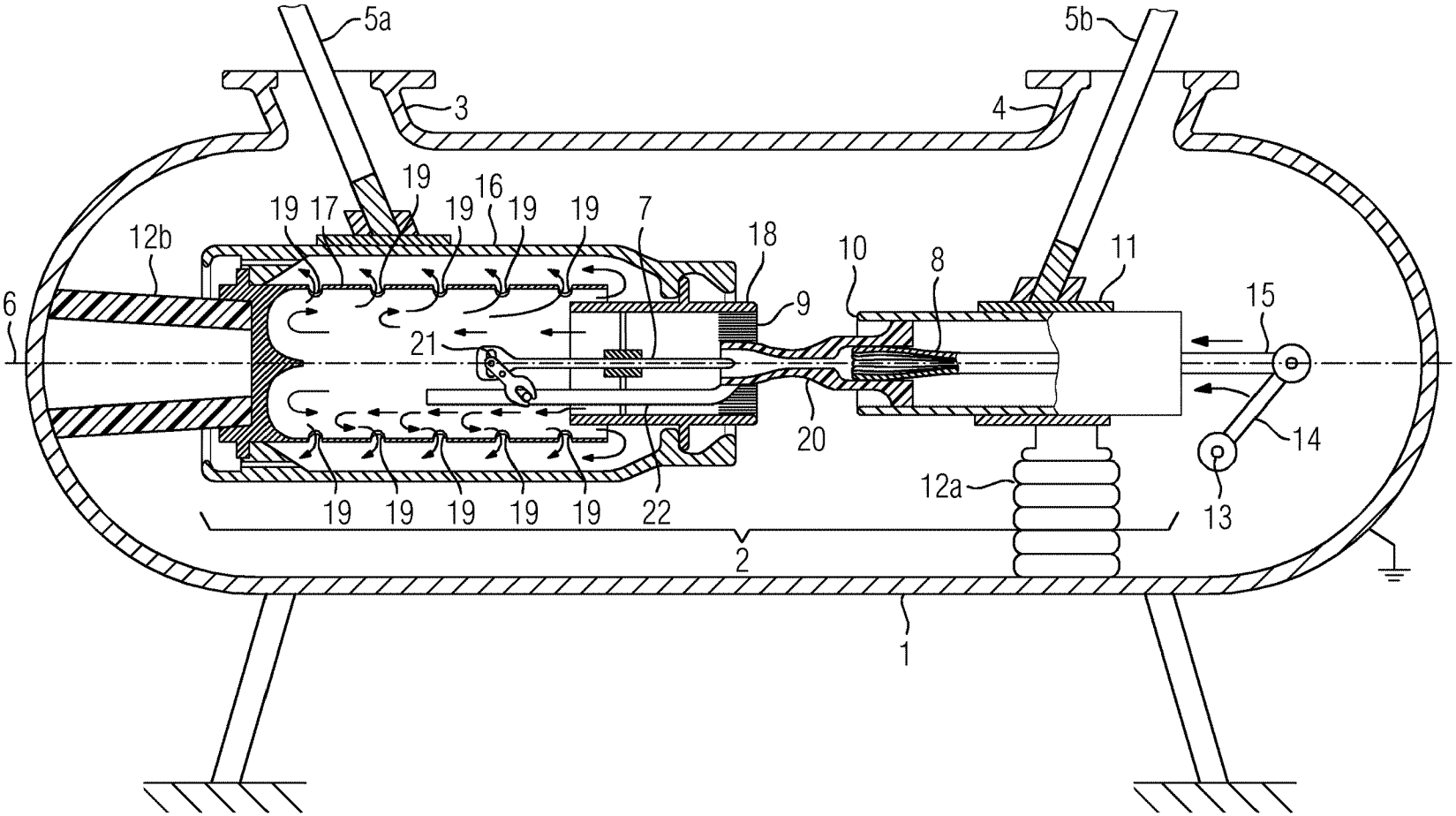
1
2
3
4
5a
5b
6
7
8
9
10
11
12a
12b
13
14
15
16
17
18
19
20
21
22

SWITCHGEAR ARRANGEMENT

BACKGROUND OF THE INVENTION

Field of the Invention

The invention relates to a switchgear arrangement having an interrupter unit comprising a first switching contact piece and a second switching contact piece, which are movable relative to one another, and comprising an arcing gas channel, which develops in an arc gap which can be formed between the switching contact pieces, which arcing gas channel passes through the interrupter unit and connects the arc gap to the surrounding environment of the interrupter unit and is at least sectionally delimited by mutually encompassing elements in the manner of a ring channel.

Such a switchgear arrangement is known, for example, from the patent specification DE 102 21 580 B3. The switchgear arrangement disclosed therein has an interrupter unit comprising an arc gap which can be formed between a first and a second switching contact piece. An arcing gas channel develops in the arc gap. The arcing gas channel extends through the interrupter unit and connects the arc gap to a surrounding environment surrounding the interrupter unit. The arcing gas channel is formed sectionally from mutually encompassing elements, as a result of which the arcing gas channel is formed sectionally in the manner of a ring channel.

In order to extend the flow path in the case of axial delimitation, in the known arrangement a change in direction of the arcing gas channel is provided. In order to effect the change in direction, various elements overlap one another, wherein in each case screwing and connection of the elements is provided sometimes in the region of overlap. As a result, a torsionally rigid structure is produced which imparts stability to the interrupter unit. However, the cross section of the arcing gas channel is reduced in the connection region. Thus, sections with an increased flow resistance result in the profile of the arcing gas channel. At these points, accumulations of flowing-away arcing gas arise, as a result of which backpressure waves can develop within the interrupter unit. Such backpressure waves can drive back as far as into the arc gap, as a result of which the switching response of the switchgear arrangement is influenced.

BRIEF SUMMARY OF THE INVENTION

Thus, an object of the invention consists in specifying a switchgear arrangement which enables improved flow away of arcing gas out of the arc gap.

According to the invention, this is achieved in the case of a switchgear arrangement of the type mentioned at the outset by virtue of the fact that a first body, clamped in at one end in the manner of a pipe connection piece, as one element protrudes with a free end towards the arc gap.

A ring channel is a channel which, for the flow of a gas, provides a cross section which runs closed in the form of a ring around a central section. Such ring channels can have, for example, a cross section in the form of a circular ring, but furthermore can also have closed cross sections in strips with any other desired shape. Thus, a ring channel can also have, for example, an oval ring cross section, a polygonal ring cross section or other ring shapes in cross section. A ring channel provides the possibility of providing a space centrally for accommodating assemblies and for enveloping these assemblies on all sides with the arcing gas channel, so that a cross section which is as large as possible for leading away arcing gas out of the arc gap is available. The arcing gas channel has an inflow opening in the region of the arc gap in order to be able to take up arcing gas from the arc gap. Arcing gas flows into the arcing gas channel through the inflow opening. An inflow opening can be delimited at least partially by one of the switching contact pieces, for example.

There is the further possibility of restricting the arcing gas channel and deflecting the arcing gas channel out of a central region into the ring-shaped region by a reversal of direction, for example, and of achieving an extension of the flow path. It may also be provided that a plurality of mutually successive ring-shaped sections of the arcing gas channel encompass one another.

Arcing gases occurring in the arc gap during a switching operation are guided away via the arcing gas channel. The section/the space of the interrupter unit within which contact-making/isolation of contact regions of the switching contact pieces which are movable relative to one another takes place is referred to as the arc gap. The arc gap can be surrounded by an arcing chamber, with the result that an arc which may be burning in the arc gap is surrounded by a wall.

A switching operation is initiated by a relative movement of the switching contact pieces with respect to one another. The switching contact pieces are movable relative to one another, for example, in order to interrupt a current path or to produce a current path. For this purpose, the switching contact pieces are moved away from one another so as to interrupt an existing galvanic contact and move towards one another in order for contact to be made, until there is sufficient galvanic contact between the switching contact pieces. During a switching operation, striking of an arc may arise. The switching contact pieces can preferably be formed as power contact pieces. Power contact pieces are switching contact pieces which are designed to guide an arc along their surfaces, wherein the choice of material for the switching contact pieces is made such that a thermal action of the arc is withstood as far as possible. For example, provision may be made for the switching contact pieces to be in the form of so-called arcing contact pieces, which are arranged electrically in parallel with the rated current contact pieces. The arcing contact pieces have the task of making contact with one another during a make operation temporally prior to the rated current contact pieces and of being isolated from one another in the event of a break operation temporally after the rated current contact pieces. This ensures that, during a make operation, a make arc preferably occurs at the arcing contact pieces/switching contact pieces and break arcs arising during a break operation are likewise preferably guided to the arcing contact pieces/switching contact pieces.

An arc/switching arc heats its surrounding environment. Overheating and expansion of gases and/or evaporation of solid or liquids can occur. The heated medium is referred to as arcing gas and is preferably guided away out of the arc gap via the arcing gas channel. The arcing gas channel directs the arcing gas away out of the interior of the interrupter unit into the surrounding environment of the interrupter unit. This ensures that the arcing gas, which can also contain products of erosion, carbon black particles and other undesired impurities, is not deposited as desired in the interior of the interrupter unit. Preferably, a large proportion, where possible all of the arcing gas, is conducted out of the interrupter unit. The arcing gas channel is arranged within the interrupter unit for this purpose.

For example, provision can be made for an electrically insulating fluid to be flushed around the switching contact pieces. In this case, for example, insulating liquids such as oils and esters, but also insulating gases such as sulfur hexafluoride gas and nitrogen gas can be used, for example. Advantageously, the fluid which flushes around the switching contact pieces can be under elevated pressure. As a result of the elevated pressure, the electric strength of the electrically insulating fluid can be additionally increased. Provision can be made for the interrupter unit to be surrounded by an encapsulating housing, within which the electrically insulating fluid is enclosed. Thus, uncontrolled volatilization of the electrically insulating fluid out of the interrupter unit is made more difficult. The surrounding environment of the interrupter unit is delimited by the encapsulating housing, i.e. the interrupter unit itself is arranged within the encapsulating housing. The electrically insulating fluid flushes around and through the interrupter unit. There is an isolating distance between the interrupter unit and the encapsulating housing, which isolating distance acts in electrically insulating fashion owing to the electrically insulating fluid. The region for takeup of the fluid between the interrupter unit and the encapsulating housing is the surrounding environment of the interrupter unit. It is thus possible to conduct the contaminated arcing gas away out of the interrupter unit into the surrounding environment thereof via the arcing gas channel and to enable swirling and mixing with electrically insulating fluid located there. As a result, weakening of the electrical insulation of the interrupter unit can be reduced to a permissible degree.

Owing to the formation of a first body in the manner of a pipe connection piece which is clamped in at one end, said first body can protrude with its free end as far as possible in cantilevered fashion and freely from further attachments with its free end in the direction of the arc gap. As a result, a wall is produced, along which the arcing gas can flow with as little resistance as possible on the inner and/or outer lateral surface side. Clamping in at one end is provided if the body, based on a longitudinal axis, is clamped in and held at one end outside a central region. The first body is borne and supported via the clamping-in. Preferably, the first body is positioned exclusively via end-side clamping-in. Holding of the first body is preferably performed at one end. Thus, the first body in the form of a pipe connection piece can protrude freely into a volume which is flooded with electrically insulating fluid, for example. If the first body is exclusively self-supporting, said body can contribute only to a limited extent to mechanical stabilization or reinforcement of the interrupter unit. The body can provide a wall for delimiting the arcing gas channel in the interior of the interrupter unit. The resilience of the first body can in this case be configured such that sufficient resistive force with respect to the inflowing or incident arcing gas is provided. This arcing gas can have a temperature increase of several 100° C. and also impact with an elevated pressure against the first body.

The first body can have, for example, a hollow-cylindrical structure, wherein a cylinder axis corresponds to the longitudinal axis of the body. The first body can be formed from electrically conductive material. Preferably, the body can be configured so as to be rotationally symmetrical and cylindrical, so that it substantially corresponds to a hollow cylinder with a cross section in the form of a circular ring, which hollow cylinder is clamped in at one end and protrudes freely, as a connection piece, into a space. Preferably, a pipe connection piece can define the path of the arcing gas channel both on the inner lateral surface side and on the outer lateral surface side. A flow through a hollow-cylindrical body can be provided on the inner lateral surface side and on the outer lateral surface side with opposite senses of direction (for example along a cylinder axis). Furthermore, as a deviation from a cylindrical configuration, any other desired shape of the body can also be provided, wherein this body extends along an axis from its clamped-in point in the direction of the arc gap, and a ring channel of any desired cross section is delimited between the first body and an encompassing element or an encompassed element.

A further advantageous configuration can provide that the first body is encompassed by a sheath acting as element, which sheath spans the free end of the first body.

A sheath encompasses and covers the first body on the outer lateral surface side, with the result that the first body is protected against direct access from the outside. Advantageously, the sheath should delimit the outer contour of the interrupter unit at least sectionally, wherein the arcing gas channel opens out into the surrounding environment of the interrupter unit. The sheath encompasses a longitudinal axis of the first body. The sheath protrudes in the axial direction at least beyond the free end of the first body. In particular, the sheath can protrude completely beyond/span the first body in the axial direction. The sheath can in particular advantageously be configured in the form of a bell, with the result that a further radial extension of the sheath is provided in a bottom region at an opposite tapered end, with the result that the sheath covers the first body firstly on the lateral surface side and secondly at the tapered end, at least partially on the front-end side. The sheath can have a conical contour. In addition, the bottom region can have a radially extending protuberance. The sheath can be substantially rotationally symmetrical and can be aligned substantially coaxially with respect to a longitudinal axis of the interrupter unit. The sheath can be used, for example, to allow the arcing gas channel to open out into the surrounding environment of the interrupter unit. An outlet opening of the arcing gas channel can thus be arranged at the sheath in such a way that the outlet opening has, for example, a shape substantially in the form of a ring or a ring segment. The outlet opening can preferably be oriented coaxially with respect to the longitudinal axis of the interrupter unit. Emergence of arcing gas into the surrounding environment should preferably take place in the direction of the longitudinal axis. Advantageously, the first body and the sheath should be shaped rotationally symmetrically. By virtue of a coaxial arrangement of the first body and the sheath, a uniform configuration of the cross section of the arcing gas channel can thus be provided. At the free end of the first body, beyond which, for example, the sheath protrudes both in the axial and the radial direction, it is possible to deflect the arcing gas channel in terms of its sense of direction and to perform a deflection through two times 90°, for example. For example, the arcing gas channel can run substantially along a longitudinal axis, wherein, alternately, an extension of the arcing gas channel with a different sense of direction can be provided along the longitudinal axis. Thus, for example, meandering of the arcing gas channel can be effected. Provision can also be made, in particular in the case of a coaxial configuration of the structures, for the arcing gas channel to be allowed to initially run centrally and, with a change of direction, for radial jumping of the arcing gas channel to be brought about such that, starting from a center, for example a plurality of hollow-cylindrical sections of the arcing gas channel are arranged successively in the form of shells. Thus, for example, the wall of the first body can advance the arcing gas channel in a first direction on the inner lateral surface side and the outer lateral surface side (for example in the direction of the longitudinal axis), wherein, on the inner lateral surface side and on the outer lateral surface side the arcing gas channel runs with the opposite sense of direction.

A further advantageous configuration can provide that a second body acting as element is clamped in at the sheath, which second body protrudes in the manner of a pipe connection piece, with a free end in the direction of the first body.

A second body, which is likewise in the form of a pipe connection piece, provides the possibility of clamping in the first body and the second body in each case at one end, wherein free ends of the first and second bodies protrude towards one another. It is thus possible to configure a shell-like radially extending arcing gas channel. The walls of the first and second bodies, which serve to divide the interior of the sheath into various stretches of the arcing gas channel, can thus protrude freely towards one another. The interior of the sheath remains free of holding and supporting elements. Thus, the arcing gas channel can be shaped correspondingly, with a low level of flow resistance, between the end-side clamped-in portions of the first and second bodies. The clamping-in of the second body serves to support and position the second body on the sheath. This is advantageously the only means by which the second body is held. The end-side clamped-in portions can be positioned at opposite ends of the two bodies. In particular when using rotationally symmetrical structures for the first and second bodies, the two bodies can be oriented coaxially with respect to one another, with the result that at ends remote from one another, on the first body and on the second body, holding and positioning of the two bodies is provided. Thus, the space between the end-side holding points of the first and second bodies can be filled in a virtually freely selectable manner with walls for the shaping of the arcing gas channel. The configuration of the second body is not restricted to a pipe connection piece. For example, only one section of the second body can be shaped in the form of a pipe connection piece, wherein the section of the second body which is in the form of a pipe connection piece protrudes from the clamped-in portion freely into the space. Furthermore, further integral formations can also be provided on the second body. The same applies to the first body. The second body can be electrically conductive in the same way as the first body. Bodies consisting of cast metal have proven to be advantageous.

A further advantageous configuration can provide that free ends protruding towards one another of the first and second bodies overlap one another.

If the first and second bodies overlap one another with their free ends, an additional path extension of the arcing gas channel in the interior of the interrupter unit is made possible in a simple manner. For example, the second body can be surrounded on the outer lateral surface side by the first body. However, provision can also be made for the first body to be surrounded by the second body on the outer lateral surface side. Overlapping of the two bodies results in the axial direction, so that a section can be formed here in which the arcing gas channel is delimited in the manner of a ring channel between the first and second bodies. Advantageously, provision should be made here for both the first body and the second body and the sheath to be arranged in locationally fixed fashion relative to one another. As a result, the geometry of the arcing gas channel is maintained and arcing gas can be guided away out of the arc gap into the surrounding environment of the interrupter unit along the arcing gas channel. An overlap of the two bodies can be more or less pronounced, depending on requirements, with the result that a section of the arcing gas channel in the form of a ring channel between the first and second bodies can be designed to be more or less long in the axial direction.

A further advantageous configuration can provide that the sheath is supported on the first body.

Supporting of the sheath makes it possible to support the first body itself in electrically insulated fashion, for example, wherein the sheath for its part is supported on the first body. Thus, fastening of the first body and fastening of the sheath in each case on the same end-side region of the sheath or of the first body can take place. The sheath and the first body can have the same electrical potential. An outlet opening of the arcing gas channel can be provided in the region in which the sheath is supported on the first body. Advantageously, the outlet opening can be arranged between the first body and the sheath, delimited thereby. Advantageously, the sheath can be supported exclusively on the first body and borne thereby.

Furthermore, it can advantageously be provided that the second body bears a contact piece.

The second body can advantageously act as contact carrier for switching contact pieces, so that the arc gap, i.e. the region in which an arc gap is located between the switching contact pieces, extends as far as up to/into the first body and can be delimited by the first body. The second body can, in the same way as in the sheath, be part of the current path to be switched by the switchgear arrangement. A switching contact piece borne by the second body can be configured as rated current contact piece, arcing contact piece etc.

Supporting the second body on the sheath makes it possible to use the sheath as bearing structure for the second body, wherein the sheath itself is mounted fixed in position. For example, it is thus possible, at mutually opposite ends (in relation to a longitudinal axis) of the sheath, to connect the sheath at one end to the first body and to clamp in said sheath and to connect the second body at the other opposite end of the sheath to the sheath and clamp in said second body. Thus, the sheath can form a section of the interrupter unit as an outer enveloping contour. The sheath can act as bearing structure for the second body and furthermore provide a wall for shaping the arcing gas channel.

Furthermore, it can advantageously be provided that the first body has, on the lateral surface side, at least one cutout covered by the sheath in the radial direction.

By virtue of introducing at least one cutout into the first body, it is possible to arrange bypasses along the profile of the arcing gas channel, with the result that parts of the arcing gas passing through the arcing gas channel are conducted over shortened paths from the arc gap in the direction of the outlet opening of the arcing gas channel of the interrupter unit. It is thus possible to swirl and displace electrically insulating gas available within the arcing gas channel prior to the occurrence of a switching operation, for example, as quickly as possible over a large length of the arcing gas channel with the arcing gas flowing away. The cutout on the lateral surface side can extend, for example, in the form of a slot or a circular cutout, through the first body, wherein, owing to the arrangement of the sheath in a radial direction, i.e. in the arcing gas passage direction through the cutout, the cutout is covered, with a spacing, by the sheath. Thus, a diversion and deflection of the arcing gas is provided and direct radial flow of the arcing gas away into the surrounding environment is prevented.

A further advantageous configuration can provide that the first body is supported, electrically insulated, on a housing surrounding the interrupter unit.

Supporting the first body on a housing surrounding the interrupter unit makes it possible to position further assemblies, starting from the first body. Thus, for example, the sheath can be supported on the first body, wherein, in turn, the second body is supported on the sheath. This results in a chain of support points which are spaced apart from one another but are arranged in angularly rigid fashion with respect to one another via one and the same common bearing mechanism. The use of an insulating body can be provided for the electrically insulated support. For example, a column-shaped post insulator can be used. The housing can be an encapsulating housing which encapsulates and hermetically seals off a fluid flushing around and through the interrupter unit, for example. The electrically insulating insulator in this case extends through the surrounding environment of the interrupter unit which is located between the interrupter unit and the encapsulating housing and is filled with the electrically insulating fluid.

Furthermore, it can advantageously be provided that the sheath is supported, electrically insulated, on a housing surrounding the interrupter unit.

The sheath can be supported directly on the surrounding housing. In this case, the sheath can be supported immediately on the housing. However, indirect support of the sheath on the housing can be provided. For example, the sheath can be formed as part of a current path for supplying an electrical current to the switching contact pieces, wherein the sheath is connected in angularly rigid fashion to further current path sections which, for their part, are supported on the encapsulating housing. Thus, the sheath can also be supported indirectly via further assemblies in electrically insulated fashion with respect to the housing.

An exemplary embodiment of the invention will be shown schematically in a drawing and described in more detail below.

BRIEF DESCRIPTION OF THE DRAWING

In the drawing:

The FIGURE shows a section through a switchgear arrangement comprising an interrupter unit.

DESCRIPTION OF THE INVENTION

The switchgear arrangement has a housing 1. The housing 1 is in this case in the form of a hermetically sealable encapsulating housing which accommodates an interrupter unit 2 in its interior. The housing 1 is in this case configured as a cast metal housing which provides a fluid-tight wall. The interior of the housing 1 is filled with an electrically insulating fluid, for example an electrically insulating gas, such as sulfur hexafluoride or nitrogen. Preferably, the housing 1 should be formed as a pressure vessel, with the result that the fluid located in the interior can also be subjected to an elevated pressure. The housing 1 has a first connection piece 3 and a second connection piece 4. It is possible to introduce a first and a second current path section 5*a*, 5*b*, in each case electrically insulated and spaced apart from the housing 1, into the interior of the housing 1 through the connection pieces 3, 4. The current path sections 5*a*, 5*b* can be brought into electrical contact with one another via the interrupter unit 2 of the switchgear arrangement or a connection between the two current path sections 5*a*, 5*b* can be interrupted by means of the interrupter unit 2. The fluid-tight termination of the housing 1 with respect to the current path sections 5*a*, 5*b* is not illustrated in the FIGURE. For example, the connection pieces 3, 4 can be closed by means of electrically insulating assemblies (through which the current path sections 5*a*, 5*b* pass in each case), with the result that the interior of the housing 1 is hermetically sealed off. Outdoor bushings which enable integration of the switchgear arrangement, for example in an outdoor switchgear assembly, can be provided as electrically insulating assemblies, for example.

Ground potential is applied to the housing 1, and the housing 1 is supported on a base via supporting feet. The interrupter unit 2 is arranged in the interior of the housing 1. The interrupter unit 2 extends along a longitudinal axis 6. The interrupter unit 2 has a first switching contact piece 7 and a second switching contact piece 8. The first switching contact piece 7 is in this case in the form of a bolt and is oriented substantially coaxially with respect to the longitudinal axis 6. The second switching contact piece 8 is in the form of a bush and is likewise arranged coaxially with respect to the longitudinal axis 6. The contact regions of the first and second switching contact pieces 7, 8 face one another, wherein the dimensions of the first and second switching contact pieces 7, 8 are selected such that, in the case of a relative movement of the two switching contact pieces 7, 8 along the longitudinal axis 6, the bolt-shaped first switching contact piece 7 can be introduced into the bush-shaped second switching contact piece 8.

The two switching contact pieces 7, 8 are in the form of arcing contact pieces of the switchgear arrangement. Correspondingly, the first switching contact piece 7 is supplemented by a first rated current contact piece 9. The second switching contact piece 8 is supplemented by a second rated current contact piece 10. The first switching contact piece 7 and the first rated current contact piece 9 as well as the second switching contact piece 8 and the second rated current contact piece 10 are brought into galvanic contact with one another, so that mutually assigned contact pieces permanently conduct the same electrical potential. In this case, the rated current contact pieces 9, 10 are configured in the form of pipes and are aligned coaxially with respect to the longitudinal axis 6, wherein the switching contact pieces 7, 8 are encompassed on the outer lateral surface side by their respectively assigned rated current contact pieces 9, 10. In the case of a make operation, it is provided that first the switching contact pieces 7, 8 make contact with one another, whereupon the two rated current contact pieces 9, 10 then make contact with one another. During a break operation, first isolation of the rated current contact pieces 9, 10 is provided, whereupon in temporal succession, isolation of the switching contact pieces 7, 8 takes place. During a make operation, the switching contact pieces 7, 8 lead the rated current contact pieces 9, 10. In the case of a break operation, the switching contact pieces 7, 8 lag the two rated current contact pieces 9, 10. The switching contact pieces 7, 8 and the rated current contact pieces 9, 10 are each held spaced apart from the housing 1 with electrical insulation.

The second rated current contact piece 10 is mounted movably in a sliding bush 11 along the longitudinal axis 6. The sliding bush 11 is electrically conductively connected to the second rated current contact piece 10. The sliding bush 11 is provided with a circular-cylindrical cross section and is arranged coaxially with respect to the longitudinal axis 6. On the outer lateral surface side, a first post insulator 12*a* is caused to stop against the sliding bush 11, which first post insulator holds the sliding bush 11 in electrically insulated fashion with respect to the housing 1 on the lateral surface side. The second rated current contact piece 10 and the second switching contact piece 8 are arranged with a rigid angle with respect to one another. Correspondingly, a movement of the second rated current contact piece 10 is accompanied by a movement of the second switching contact piece 8.

In order to couple a movement into the interior of the housing 1 and to effect a relative movement between the two switching contact pieces 7, 8, a shaft 13 passes through a wall of the housing 1 in fluid-tight fashion. The shaft 13 is mounted rotatably, with the result that a drive movement can be transferred in fluid-tight fashion into the interior of the housing 1 via a drive device arranged on the outer side of the encapsulating housing 1. A pivot lever 14 is arranged on the inner wall side on the shaft 13. A rotary movement of the shaft 13 can be converted into a linear movement along the longitudinal axis 6 by means of a conrod 15 via the pivot lever 14. The conrod 15 is connected to the second rated current contact piece 10. It is thus possible for the second rated current contact piece 10 and the second switching contact piece 8 to be moved along the longitudinal axis 6, guided in the sliding bush 11. A contact region is arranged on the sliding bush 11 in order to make electrically conductive contact between the second current path section 5*b*, via the sliding bush 11, and the second rated current contact piece 10 or the second switching contact piece 8.

In order to position the first rated current contact piece 9 and the first switching contact piece 7, a sheath 16 is provided. The sheath 16 has a bell-shaped structure, wherein the sheath bottom extends radially at its end remote from the second rated current contact piece 10 or the second switching contact piece 8. On the lateral surface side, a contact region is arranged on the sheath 16, into which contact region the first current path section 5*a* protrudes, with the result that electrical contact can be made with the sheath 16. The sheath 16 is thus part of a current path to be switched. The sheath 16 is substantially rotationally symmetrical, wherein the axis of rotation is arranged congruently with respect to the longitudinal axis 6.

Furthermore, a further post insulator 12*b* is provided, which in this case is configured as a rotationally symmetrical hollow insulator and is arranged coaxially with respect to the longitudinal axis 6. A first body 17 is caused to stop against the second post insulator 12*b*, wherein the first body 17 is substantially rotationally symmetrical and is oriented coaxially with respect to the longitudinal axis 6. In turn, the sheath 16 is caused to stop against the first body 17. The sheath 16 encompasses the first body 17 on the outer lateral surface side. The sheath 16 can also be supported directly on the second post insulator 12*a* and the first body 17 can be supported on the sheath 16. It is also possible for both the sheath 16 and the first body 17 to be supported directly on the second post insulator 12*a*. The first body 17 is in this case in the form of a pipe connection piece, wherein the pipe connection piece is fastened at one end and, with its free end, protrudes in the direction of the arc gap, which is formed between the switching contact pieces 7, 8 or the rated current contact pieces 9, 10, freely into the interior of the sheath 16. The first body 17 is sealed at one end in the region of its clamped-in portion at the front end. In relation to the longitudinal axis 6, a second body 18 is supported on the sheath 16 at the opposite end from the connection of the sheath 16 to the first body 17. The sheath 16 encompasses the second body 18 on the outer lateral surface side, wherein the second body 18 is formed sectionally as pipe connection piece. The second body 18 or the pipe connection piece has an inflow opening of the arcing gas channel. In this case, the inflow opening is at least partially delimited by the rated current contact piece 9. The second body 18 is clamped in on the sheath 16, with the result that a pipe connection piece-like section is fixed. The pipe connection piece-like section of the second body 18 protrudes with one free end in the direction of the free end of the first body 17.

The second body 18 acts as a mount for at least one contact piece. In this case, the first switching contact piece 7 and the second rated current contact piece 9 are supported on the second body 18. The second body 18 positions elastically deformable contact figures so as to form a contact region of the first rated current contact piece 9. Correspondingly, the second body 18 is part of a current path of the switchgear arrangement to be switched. The two bodies 17, 18 overlap one another with their ends protruding in each case freely from their clamped-in points of their pipe connection piece-like sections. In this case, it is provided that the second body 18 protrudes into the first body 17 and is encompassed by the first body 17 on the outer lateral surface side. The second body 18 encompasses an arcing gas channel, which continues from the arc gap and protrudes into the interior of the first body 17. A deflection of the arcing gas channel is provided in the region of overlap of the two bodies 17, 18, wherein the arcing gas channel has a section with a structure in the form of a ring channel between the two bodies 17, 18. Furthermore, a further section of the arcing gas channel is formed between the outer lateral surface of the second body 18 and the inner lateral surface of the sheath 16, which further section is in the form of a ring channel. As the profile of the arcing gas channel continues, a section of the arcing gas channel which likewise has a structure in the form of a ring channel is formed between the outer lateral surface of the first body 17 and the inner lateral surface of the sheath 16. In the region in which the first body 17 is fastened on the second post insulator 12*b*, an outlet opening of the arcing gas channel into the surrounding environment of the interrupter unit 2 is provided. The outlet opening of the arcing gas channel is preferably in the form of a circular ring and is preferably oriented coaxially with respect to the longitudinal axis 6. Instead of a structure in the form of a circular ring, one or more segments of a circular ring can also be used as outlet opening.

The first body 17 has a plurality of cutouts 19 on the lateral surface side. The cutouts 19 are oriented substantially radially with respect to the longitudinal axis 6, with the result that a radial flow-away direction for arcing gas emerging through the cutouts 19 is defined. The cutouts 19 are each spanned on the outer lateral surface side by the sheath 16, with the result that arcing gas passing through the cutouts 19 hits against the sheath 16 and is swirled and deflected there.

The second switching contact piece 8 is encompassed by an insulating nozzle 20 on the outer lateral surface side. The insulating nozzle 20 is in turn encompassed by the second rated current contact piece 10 on the outer lateral surface side. The insulating nozzle 20 has an insulating nozzle channel, into which the first switching contact piece 7 can be moved in order to be able to come into contact with the bush-shaped contact region of the second switching contact piece 8. In this case, it is provided that both the first and the second switching contact pieces 7, 8 are mounted in locationally variable fashion in order to effect a relative movement of the switching contact pieces 7, 8 relative to one another. In the case of the rated current contact pieces 9, 10, on the other hand, only a movable mounting of the second rated current contact piece 10 is provided, whereas the first rated current contact piece 9 is fixed in position on the sheath 16. In order to drive the first switching contact piece 7, a deflection gear mechanism 21 is provided, which is connected to the insulating nozzle 20 via a coupling rod 22. A movement of the second rated current contact piece 10 results in a movement of the coupling rod 22. A movement of the coupling rod 22 is transferred to the first switching contact piece 7 via a coupling gear mechanism 21. The coupling gear mechanism 21 reverses the sense of direction of the movement of the coupling rod 22. The first switching contact piece 7 moves with the reverse sense of direction to that of the second switching contact piece 8. By virtue of the use of an insulating nozzle 20, which is movable together with the second rated current contact piece 10 and the second switching contact piece 8, a movement can be transferred onto the first switching contact piece 7 in electrically insulated fashion. During a make operation, the second rated current contact piece 10 and the second switching contact piece 8 are moved in the direction of the first rated current contact piece 9 and the first switching contact piece 7, respectively. Via the insulating nozzle 20, the coupling rod 22 and the deflection gear mechanism 21, a movement with the opposite sense of direction is transferred to the first switching contact piece 7, with the result that an increase in the contact-making speed of the two switching contact pieces 7, 8 takes place. This ensures that the switching contact pieces 7, 8 touch one another temporally prior to the rated current contact pieces 9, 10, with the result that make arcs are preferably guided to the switching contact pieces 7, 8. During a break operation, a movement of the second rated current contact piece 10 and of the second switching contact piece 8 and the insulating nozzle 20 fastened thereto away from the first switching contact piece 7 and the first rated current contact piece 9 takes place. In the process, first an isolation of the two rated current contact pieces 9, 10 with respect to one another and temporally thereafter, isolation of the two switching contact pieces 7, 8 from one another take place. Correspondingly, commutation of a break current from the rated current contact pieces 9, 10 onto the switching contact pieces 7, 8 takes place. An arc which is possibly struck is guided between the switching contact pieces 7, 8. Owing to the configuration of the insulating nozzle 20, an arc is preferably kept within this insulating nozzle 20.

Arcing gas occurring preferably flows away in the direction of the first switching contact piece 7. The arcing gas flows into the arcing gas channel, which is initially delimited by the second body 18. The arcing gas is directed in the direction of the longitudinal axis 6. Owing to an elevated pressure continuing to prevail in the arc gap, a backflow of arcing gas is prevented. The arcing gas then flows along the path of the arcing gas channel towards a closed end side of the first body 17 and is deflected and firstly directed radially outwards through the cutouts 19 in the first body 17. Secondly, however, it is also pressed through the region of overlap in the form of a ring channel between the first and second bodies 17, 18. From there, the arcing gas continues to flow through the section in the form of a ring channel, which section is formed between the outer lateral surface of the second body 18 and the inner lateral surface of the sheath 16 in order to flow from this region, with the reversal of the sense of direction, again through a section of the arcing gas channel which is in the form of a ring channel, which section is delimited between the outer lateral surface of the first body 17 and the inner lateral surface of the sheath 16. Ultimately, the arcing gas flows, after multiple changes in the sense of direction, out of the interrupter unit 2 and flows into the surrounding environment of the interrupter unit 2. There, the arcing gas can further be mixed with electrically insulating fluid located in the surrounding environment of the interrupter unit 2 and swirled therewith.

The invention claimed is:

1. A switchgear arrangement, comprising:

an interrupter unit having first and second switching contact pieces movably disposed relative to one another;

an arcing gas channel issuing from an arc gap to be formed between said first and second switching contact pieces, passing through said interrupter unit and connecting said arc gap to a surrounding environment of said interrupter unit;

mutually encompassing elements at least sectionally delimiting said arcing gas channel in a form of a ring channel, said elements including a first body having one end clamped as a pipe connection piece at a support distal from said arc gap and a free end projecting towards said arc gap, said first body having a lateral surface side formed with at least one cutout;

a sheath encompassing said first body and spanning said free end of said first body, and said sheath covering said at least one cutout in the lateral surface side of said first body in a radial direction; and a housing surrounding said interrupter unit, wherein said sheath is supported on said housing and electrically insulated therefrom.

2. The switchgear arrangement according to claim 1, wherein said mutually encompassing elements include a second body clamped in at said sheath and projecting as a pipe connection piece with a free end in a direction of said first body.

3. The switchgear arrangement according to claim 2, wherein said free ends of said first and second bodies project towards one another and overlap one another.

4. The switchgear arrangement according to claim 2, wherein said second body bears one of said first and second contact pieces.

5. The switchgear arrangement according to claim 1, wherein said sheath is supported on said first body.

6. The switchgear arrangement according to claim 1, wherein said first body is supported on said housing and electrically insulated therefrom.

7. The switchgear arrangement according to claim 1, which comprises a post insulator mounted to said housing and supporting said sheath directly at said housing.

* * * * *